US005192587A

United States Patent [19]

Rondy

[11] Patent Number: 5,192,587

[45] Date of Patent: Mar. 9, 1993

[54] METHOD FOR COLORING WOOD CHIPS

[75] Inventor: Gregory J. Rondy, Barberton, Ohio

[73] Assignee: Kurtz Bros., Inc., Cuyahoga Heights, Ohio

[21] Appl. No.: 749,141

[22] Filed: Aug. 23, 1991

[51] Int. Cl.[5] ..... B05D 7/06

[52] U.S. Cl. ..... 427/212; 427/440; 118/417; 118/426; 118/429; 118/693; 47/9

[58] Field of Search ..... 427/212, 440; 118/693, 118/417, 426, 429; 47/9, DIG. 10; 428/541

[56] References Cited

U.S. PATENT DOCUMENTS

| | | | |
|---|---|---|---|
| 4,067,140 | 1/1978 | Thomas | 47/9 |
| 4,337,720 | 7/1982 | Häger | 427/440 |
| 4,491,504 | 1/1985 | Engall | 162/237 |
| 4,788,790 | 12/1988 | Zeager | 47/9 |
| 4,932,156 | 6/1990 | Underwood | 47/9 |

FOREIGN PATENT DOCUMENTS

| | | | |
|---|---|---|---|
| 438531 | 1/1975 | U.S.S.R. | 118/417 |
| 617083 | 7/1978 | U.S.S.R. | 118/426 |

OTHER PUBLICATIONS

Mulch Producers Use of Mulch Colorants The Becker-Underwood Company Mar. 1991 pp. 1-6.

*Primary Examiner*—Shrive Beck
*Assistant Examiner*—Terry J. Owens
*Attorney, Agent, or Firm*—Oldham, Oldham & Wilson

[57] ABSTRACT

Comminuted wood is converted to a colored wood product useful as a mulch by feeding the comminuted wood into the lower end of an angularly upward positioned screw conveyor having an internal auger. The comminuted wood is contacted in a basin in the lower end of the conveyor by a liquid color-imparting agent, preferably an aqueous solution containing iron oxide pigment, carbon black pigment or a mixture of both pigments. After contacting, rotation of the auger draws the moist colored wood product towards the upper end, permitting runoff of excess liquid agent, which returns by gravity to the basin for further contacting with newly-fed comminuted wood. The liquid level in the basin is monitored and additional liquid agent is blended from water and pigment concentrate to maintain the level in the basin. Colored wood product discharges through a chute at the upper end of the conveyor for further drying, if necessary.

7 Claims, 2 Drawing Sheets

METHOD FOR COLORING WOOD CHIPS

This invention relates to method for applying a coloring agent to ground wood chips to make a product having aesthetical pleasing appearance. Even more particularly, the present invention relates to a method for contacting uncolored wood chips in an aqueous solution containing a coloring agent and moving the wood chips from the coloring agent by us of a screw auger so that excess coloring agent may flow back into the basin containing the coloring agent. Even more particularly, the present invention relates to a method of using ground wood chips, particularly wood chips derived from used lumber, thereby eliminating the disposal problem of such lumber.

BACKGROUND ART

It is well known to utilize dark colored chips of wood as a mulch material in gardening applications. In such applications, the coloration of the wood chip material is critical to the marketability of the product. Particularly, wood chips prepared from the bark of certain tress, especially aromatic trees such as pine and cedar trees, have high marketability. The distinctive color of such mulches, particularly the bark mulches, is typically a dark shade ranging from a reddish-orange color to a deep brown color. At least as important as the exact color is a uniformity of color in the mulch. A blonde colored mulch seems to lack the attraction of a dark mulch material for gardening applications.

Although the preferable material in a mulch may be the bark, it is clear that the supply of such mulch is limited and generally not expandable without expanding the amount of wood being felled. At the same time, however, there is a significant amount of lumber, particularly light colored lumber as used in producing pallets, that is disposed of yearly. If this material were capable of being converted into an aesthetically pleasing mulch material that would compete favorably with the bark mulches on the market, the inherent problems of land filling with this material could be avoided. Additionally, the supply of available light colored lumber of this sort is at least adequate to meet the demand that would be made for the preferred mulch material. In this way, an additional supply of a desired product is brought to the market without increasing the destruction of forest lands and an ecologically sound disposition of the material, otherwise landfilled, is also achieved.

It is also known that surface oxidation of light colored lumber will occur naturally, resulting in a darker colored material. It is not generally feasible to use this natural darkening through oxidation, however, to prepare a dark colored mulch material. This is because the natural oxidation is subject to variation among the wood, so that achievement of a uniform color is certainly not at all probable. Additionally, it is desirable to move the wood through a processing facility in a rapid fashion so that no piles of ground wood are sitting around waiting for the natural oxidation of the surfaces to occur. It is well known that, under proper weather conditions, a ground wood pile can spontaneously combust due to the heat generated internally to the pile by the oxidation process.

SUMMARY OF THE INVENTION

It is, therefore, a first object of the invention to provide a method and apparatus for converting a ground wood stock into colored wood mulch material.

It is a second object of the invention to provide an additional source for a darkly colored mulch material that is equivalent in the marketplace to a bark mulch product.

It is a further object of the invention to provide a method of disposing of used lumber without the necessity of disposition in a land fill.

These and further objects of the invention are provided by a method and a device for preparing a colored wood product, useful as mulch.

The method comprises feeding comminuted wood into an angularly upward positioned screw conveyor with a lower end and an upper end. The screw conveyor has a helical auger disposed axially within a generally closed cylindrical channel with a feed port near the lower end and a discharge port near the upper end. The helical auger is capable of being rotated by a drive means, and the angularly positioned lower end of the cylindrical channel effectively forms a basin portion for the retention of liquid. The comminuted wood is contacted with an aqueous color-imparting solution containing at least one color-imparting agent in the portion therein, said contact occurring in the basin portion for sufficient time to disperse the color-imparting solution upon the surfaces of said comminuted wood, effectively forming a wet colored wood product. By rotating the auger so that the wet colored wood product is drawn upwardly out of the basin and toward the upper end, excess color-imparting solution drains away from the wet colored wood product and returns by gravity to the basin portion, effectively drying the wet colored wood product into a moist colored wood product, which is discharged from the screw conveyor via said discharge port. Further drying of the moist colored wood product may be provided.

The method is preferably conducted in a continuous manner by feeding the comminuted wood continuously into the lower end of the screw conveyor, continuously monitoring the liquid level in the basin, and adding additional amounts of color-imparting solution. To monitor and control the basin liquid level, an auxiliary tank is provided in communication with the basin portion such that a change in level in the basin portion causes a directly proportional change in the auxiliary tank, a means for sensing the level of the auxiliary tank and providing a signal to a pump means to inject the make-up aqueous color-imparting solution is provided. The pump means is in communication with a source of said make-up aqueous color-imparting solution.

In a preferred embodiment, the make-up aqueous colorimparting solution is prepared by injecting a sufficient quantity of a color-imparting concentrate to a sufficient quantity of water. The preferred aqueous color-imparting solution comprises a mixture of iron oxide pigment in liquid suspension and carbon black pigment in liquid suspension, wherein the iron oxide mixture ranges from about 5 percent by volume to about 100 percent by volume and the carbon black mixture range from about 5 percent by volume to about 100 percent by volume.

DETAILED DESCRIPTION OF THE DRAWINGS AND THE PREFERRED EMBODIMENT

Figure 1:
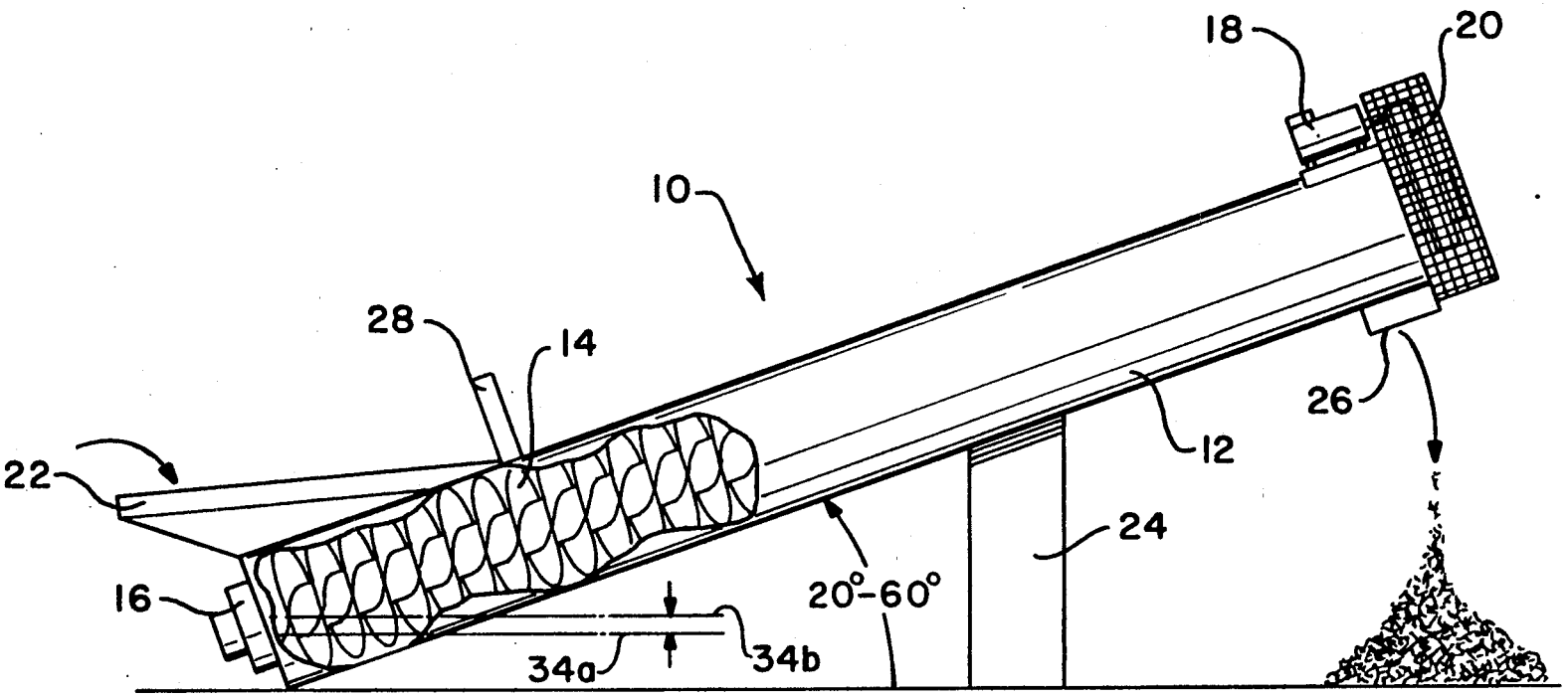
FIG. 1 is a partially broken away side elevational view showing the apparatus of the invention.

As used in this application for patent, the term "mulch" refers to leaves, straw or other loose material spread on the ground around plants to prevent evaporation of water from soil, freezing of roots, and the like. A commonly used and certainly preferred source of mulch for landscaping purposes is a chipped product produced by comminution of bark products from trees, particularly dark colored trees and, even more particularly, trees possessing an aromatic wood bark, such as the bark of the pine, cedar or other trees, especially the aromatic woods.

As used in this application for patent, the term "wood mulch" particularly relates to the mulch that is prepared from woody material rather than leaves. The term "wood mulch" particularly is used in this application to refer to a product that is not only prepared from such woody material, but is typically irregular in shape with a thickness of up to 2 inches, a width of up to 4 inches and a length of up to 4 inches or so. When viewed parallel to the shortest dimension, the typical bark mulch product is seen to have elliptical to circular cross section. The typical bark mulch has a color which varies from a reddish-orange to a dark brown hue.

As used in this application for patent, the term "wood" means the hard fibrous substance found beneath the bark in the stems, branches and roots of trees and shrubs. This material is referred to as "wood" regardless of whether it is unconverted from its natural state, as in the case of a tree trunk, or whether it has been converted into a wood product such as a plank, stave, board, or other piece of lumber.

The process of the present invention is generally practiced by starting with wood as defined hereinabove. This wood, in whatever form, may be passed through a comminuting machine such as is well known in the art, resulting in a comminuted or chipped material that has a size consist as determined by the operating parameters of the comminuting machine. The variety of sources of such wood allows a great deal of discretion to the operator of the process. Such an operator may choose from wood from a wide spectrum of sources ranging from excess branches and material pared from tree trimmings to lumber that has had previous use, such as in discarded pallets, used barrel staves and the like. It would appear that there is some preference in the coloring process for wood that is not "green", i.e., the preferred wood has been dried or dewatered significantly from its naturally occurring state. This aging of the wood can be achieved by a variety of processes, all of them within the grasp of the practitioner of this art. The preferable material is a dry wood having 30 percent moisture or less that is ground so that it passes through a 1¾ inch screen. Green wood, i.e. wood having from 30 to 80 percent moisture content may be used for the process and the process has been successfully used on wood ranging from virtually powdered material to sticks of 1¾ inch×1¾ inch×8 inch. In referring to moisture content, we refer to the moisture retained in the wood from the original cutting rather than moisture absorbed during storage or grinding procedure.

As practiced, the present invention utilizes an auger screw such as the 36 inch×26 foot Fine Material Screw produced by Eagle Crusher Co. of Galion, Ohio. A screw of this type comprises a generally cylindrical channel with a helical auger positioned axially inside. The auger is connected to a motor means so that rotation of the screw may be effected. When the motor device is positioned in an angular relationship with the ground so that there is a higher end and a lower end of the device, the lower end thereof will effectively form a basin wherein a coloring solution may be added. Comminuted, uncolored wood may be added to the basin for contacting with the coloring solution. By activating the motor means and causing the auger screw to rotate in a first direction, the screw device may be used as an Archimedean screw, i.e. a device for raising liquid or loose material such as sand, cement, or the like from a lower level to a higher level by rotation of the screw. If the auger screw were positioned in the cylindrical channel in a relatively tight and waterproof relationship, the coloring liquid in the basin would be simultaneously lifted from the basin to the upper end of the screw device. However, if the relationship between the auger screw end and the channel is somewhat looser, the peripheral portion of the auger screw in conjunction with the channel will permit the flow of excess coloring liquid back into the basin as it disengages itself from the moistened, and now colored, wood that has been drawn upwardly by the action of the screw. As the wood reaches the upper end of the screw device, an aperture on the lower surface of the channel permits the discharge of the colored wood product from the channel and the screw device.

In operating the device for coloring a wood product, a steady feed of material into the basin is recommended to achieve the most economical coating.

The exact parameters for operating the screw device will, of course, depend upon the various conditions being used, including, but not limited to, the moisture content of the wood, the strength of the coloring material solution and ambient conditions. However, it is noted that a 20 rpm speed on the specific Fine Material Screw cited above will easily process 50 cu. yds. of material per hour when driven with a 10 hp motor through a reduced drive gear box. Increasing the rpm will increase the productivity of the screw device but the excessive loading of the screw will tend to impede the drainage of colorant away from the material and excessive speed will result in reduced contact time and insufficient color in the material. Other variables noted to affect the operation of the screw device include the size of the individual particles, the percent of fine particles and the type of wood in use.

An important feature of the screw device is the implementation of a liquid level control system to control operation of the coloring basin. This is best achieved by the simple addition of an auxiliary tank in communication with the main coloring basin, wherein an electric float switch monitors the current level in the main coloring basin and activates an electric water valve on an "on/off" basis to allow makeup water to be added into the basin.

The inventor has determined when the Eagle 36 inch×26 foot Fine Material Screw is operated at 20 rpm and is fed with material comprising 75 percent coarse (i.e. material passing through a 1¾ inch screen) and 25 percent fine (i.e. material passing through a ⅜ inch screen) approximately 20 to 30 gallons of water will be required per cubic yard of wood chips when the wood chips are added at a steady rate. It is preferred in the addition of water that the colorant material is directly injected into the water prior to the entry of the water into the colorant basin. A variety of chemical injection pumps are well known and would be suitably adapted to this purpose. In the preferred embodiment presently known to the inventor, a discharge pump is the best because it will pass chunks of pigment or small wood chips.

The color imparting agent may be selected from one of a variety of colorant agents. The inventor's preferred colorant material is a commercially available blend that contains mixture of an iron oxide pigment with a dispersion of carbon black. These coloring concentrates should be injected to water at a rate of about 0.25% to about 1% volumes of concentrate per volume of water. The most preferred injection rate is from about 0.5 percent to about 0.6% volumes of concentrate per volume of water.

DETAILED DESCRIPTION OF THE DRAWINGS AND THE PREFERRED EMBODIMENT

With reference to the embodiment of the invention illustrated in FIG. 1 of the drawings, the numeral 10 indicates generally the apparatus of the invention which comprises a long cylindrical housing 12, which receives a rotatable auger or screw 14, such screw or auger being rotatably mounted at each end in bearing units with numeral 16 showing on the left end and the bearing unit mounted inside and not shown on the right or upper end. The auger 14 is rotated by means of motor 18 driving a belt 20 which connects to the protruding end of the auger. Any type of typical mechanism to achieve the desired rotation of the auger at a desired speed would meet the objects of the invention.

An input chute for materials is indicated by numeral 22, and normally it is contemplated that the chips will come directly from a chipper and the unit will function on a continuous basis as chipped wood material comes out of the chipper unit. The input chute feeds down into the auger and provides a continuous amount of chipped material dropping down onto the auger itself. The unit 10 is mounted in an upwardly inclined position by a support 24 which can be adjustably positioned so that the upward tilt of the housing 12 would be between 20° to about 60°, but preferably at about 30–40° to provide a continuous upward movement of the wood chips from the coloring liquid at the lower left end, and then progressing upwardly and drying while dripping back any excess fluids to then ultimately be discharged from an output chute 26 at the upper right end of the cylindrical cover 12. A baffle 28 may be provided at the front edge of the input chute so that any material flying out will be deflected downwardly into the auger fluid level arrangement.

FIG. 1 also indicates that the top fluid level will be at about the central position of the auger 14 which is contemplated to be approximately 36 inches in diameter and 26 feet long and identified as a substantially "fine material screw". The lower fluid level indicator shows how the level will drop and be sensed by the fluid sensing level to add more liquid, as described with respect to FIG. 2 hereinafter.

Figure 2:
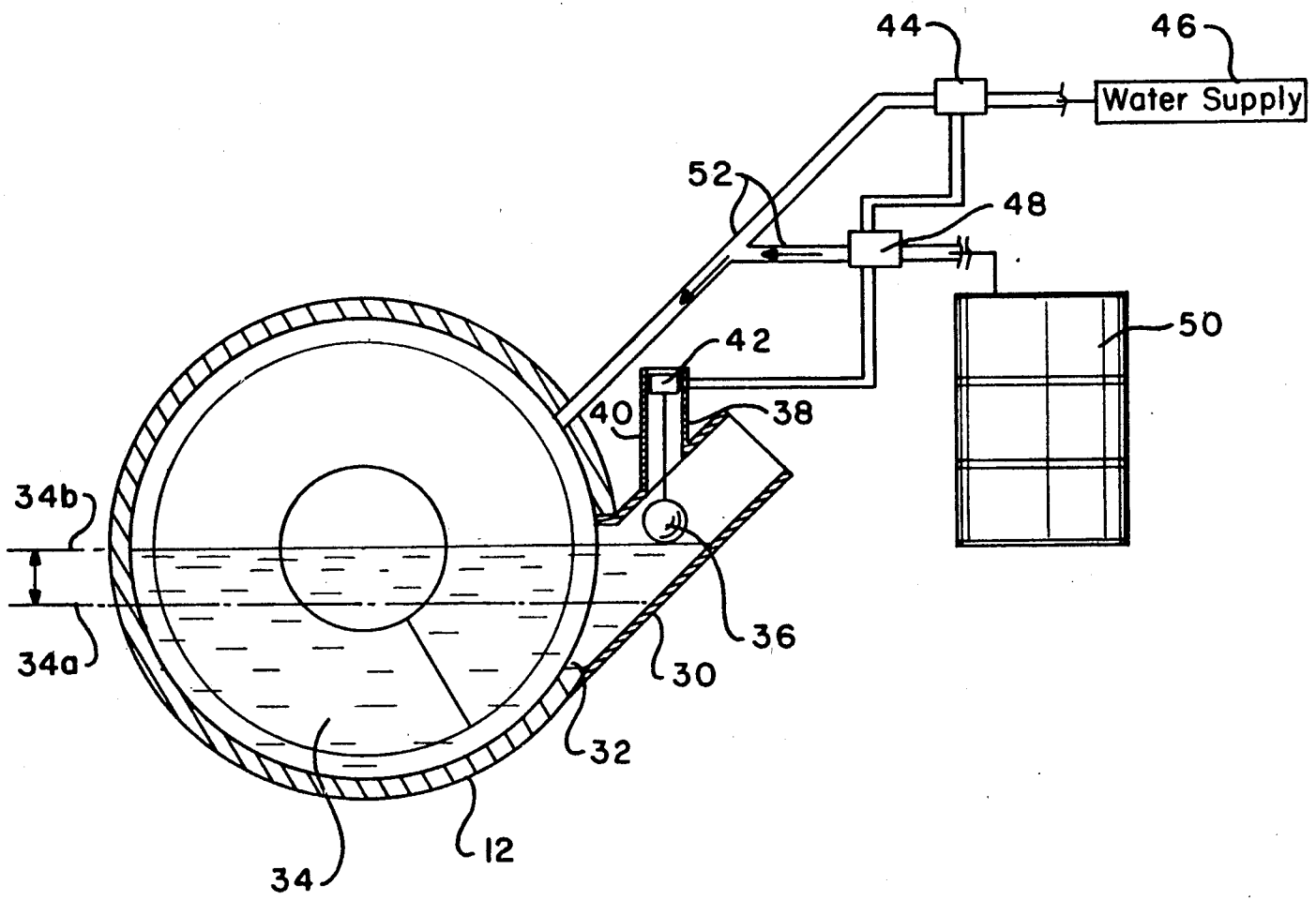
FIG. 2 is an end cross-sectional view of the auger screw showing the water level sensing system and schematically illustrating the control to the mixing of the color supply and the water supply to add coloring liquid to the mixing achieved by the auger in the receiving bin.

Looking at FIG. 2, the fluid level is determined by providing a fluid level sensing pipe or auxiliary tank 30 projecting at a about a 45° angle off the housing 12, which would be adjacent the bottom end of the housing or at the very left lower corner of the housing as seen in FIG. 1, but pipe 30 is not shown because of the broken away relationship of the drawing. In any event, it is contemplated that an approximately 8 inch diameter pipe will fit into and communicate then with the elliptically shaped opening 32 in the wall of housing 12 allowing the liquid indicated by numeral 34 to communicate freely up into the pipe 30. A buoyant ball or float 36 connected to rod 38 is adapted to move up and down in connecting pipe 40 thus allowing float 36 to move vertically up and down showing the level of the fluid 34. This rod 38 cooperates with a switch 42 to actuate the liquid valve 44 from water supply 46 as well as the color pump 48 to draw colorant from the color supply drum 50 when the float 36 drops to a predetermined level indicated as **34*a*, this being the lower operating level, with fluid then directed in their respective pipes as shown by arrows 52 to fill the fluid level up to 34*b*, at which time switch 42 disengages both the valve 44 and the pump 48, until the float 36 drops to level 34*a* again. It has been found that this arrangement of the large pipe 30 eliminates any problem with wood chips causing a disruption or any malfunction of the float 36, since its impossible for any chips to get up into and foul up the upward vertical reciprocal motion of rod 38 as actuated by float 36**. In this way no screens or any other means of preventing chips or any of &he fines from disrupting the sensing of the water level are needed.

The iron oxide and carbon black alone or in combination will provide a permanent coloration of the chips that should not leach out. It would be possible and, indeed, desirable in some cases to supplement the color imparting agent with other desired chemicals.

While in accordance with the patent statutes, the best mode and preferred embodiment of the invention have been described, it is to be understood that the invention is not limited thereto, but rather is to be measured by the scope and spirit of the appended claims.

What is claimed is:

1. A method of preparing a colored wood product, useful as mulch, comprising:

a) feeding comminuted wood into an angularly upward positioned screw conveyor having a first end situated lower than a second end thereof, said screw conveyor further having a solid helical auger disposed axially within and in a close fitting relation to the internal surface of a generally closed cylindrical channel with a feed port near said first end on the top side of the conveyor and a discharge port near said second ed on the bottom side of the conveyor, said helical auger capable of being rotated by a drive means, and the angularly positioned first end of said cylindrical channel effectively forming a basin portion for the retention of liquid, wherein the comminuted wood is fed in a continuous manner by a gravity feed on top of the auger through the feed port into said first end of said angularly upwardly positioned screw conveyor, b) contacting said comminuted wood with an aqueous color-imparting solution containing at least one color-imparting agent therein, said contact occurring in the basin portion of said screw conveyor for sufficient time to disperse said color-imparting solution upon the surfaces of said comminuted wood, effectively forming a wet colored wood product;

c) rotating the auger whereby the auger sides remain in close proximity to the internal surface of the cylindrical channel so that said wet colored wood product is drawn upwardly out of said basin and toward said second end, during whicih process excess said color-imparting solution drains away from said wet colored wood product and returns by gravity to said basin portion, effectively drying said wet colored wood product into a moist colored wood product; and d) discharging said moist colored wood product by gravity from said screw conveyor via said discharge port and, if necessary further drying said moist colored wood product.

2. The method of claim 1 wherein the level of the aqueous color-imparting solution in said basin portion is monitored in a continuous manner by a level-controlling means and the level is maintained by adding a sufficient amount of make-up aqueous color-imparting solution, and wherein the upwardly positioned screw conveyor is at an angle of between about 20° to about 60°.

3. The method of claim 2 wherein the level-controlling means comprises:

an auxiliary tank in communication with said basin portion such that a change in level in said basin portion causes a directly proportional change in level in said auxiliary tank;

a means for sensing the level in said auxiliary tank and providing a signal to a pump means to inject said make-up aqueous color-imparting solution into said basin portion; and said pump means in communication with a source of said make-up aqueous color-imparting solution.

4. The method of claim 2 wherein the make-up aqueous color-imparting solution is prepared by injecting a sufficient quantity of a color-imparting concentrate to a sufficient quantity of water.

5. The method of claim 1 wherein the aqueous color-imparting solution comprises a mixture of iron oxide pigment in liquid suspension and carbon black pigment in liquid suspension diluted by a vigorous mixing with water immediately prior to its application to the comminuted wood chips, and wherein the iron oxide mixture ranges from about 5 percent by volume to about 100 percent by volume and the carbon black mixture ranges from about 100 percent by volume to about 5 percent by volume.

6. A method according to claim 1 wherein the comminuted wood comprises 75 percent coarse material capable of passing through a 1¾ inch screen and 25 percent fine material capable of passing through a ⅜ inch screen.

7. A process according to claim 1 wherein the comminuted wood is essentially dry having approximately a 30 percent moisture content.

* * * * *